US007886764B2

(12) United States Patent
Spiegl et al.

(10) Patent No.: US 7,886,764 B2
(45) Date of Patent: Feb. 15, 2011

(54) AUTOMATIC ANNULAR VALVE

(75) Inventors: Bernhard Spiegl, Vienna (AT); Markus Testori, Hollabrunn (AT); Peter Steinrück, Hallstatt (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 173 days.

(21) Appl. No.: 11/987,914

(22) Filed: Dec. 5, 2007

(65) Prior Publication Data

US 2008/0149196 A1 Jun. 26, 2008

(30) Foreign Application Priority Data

Dec. 22, 2006 (AT) ..... A 2126/2006

(51) Int. Cl.
*F16K 17/04* (2006.01)

(52) U.S. Cl. ..... 137/516.13

(58) Field of Classification Search ..... 137/516.21, 137/859, 516.23, 516, 516.25–516.27, 521, 137/845, 512.1, 515.7, 516.13
See application file for complete search history.

(56) References Cited

U.S. PATENT DOCUMENTS 1,890,051 A * 12/1932 Gehres ..... 137/454.4
3,489,334 A * 1/1970 Garland ..... 417/569
3,703,912 A 11/1972 Bauer et al.
3,805,827 A * 4/1974 Kennedy et al. ..... 137/516.17
4,570,666 A * 2/1986 Hartshorn ..... 137/512.1
4,723,572 A 2/1988 Tuymer
4,854,341 A 8/1989 Bauer
4,924,906 A * 5/1990 Hrabal ..... 137/512.1
5,678,603 A * 10/1997 Tschop ..... 137/512.1
6,149,400 A 11/2000 Samland et al.

FOREIGN PATENT DOCUMENTS

GB 924310 4/1963
WO 03006826 1/2003

* cited by examiner

*Primary Examiner*—John Rivell
*Assistant Examiner*—Macade Brown
(74) *Attorney, Agent, or Firm*—Dykema Gossett PLLC

(57) ABSTRACT

A metallic separating plate 6 is arranged between the sealing rings 5 and the synchronizing plate 7 to prevent mutual wear of the sealing rings 5 and the synchronizing plate 7 in an annular valve having sealing rings 5 as sealing elements and a synchronizing plate 7 to synchronize and dampen the ring opening movement.

10 Claims, 6 Drawing Sheets

AUTOMATIC ANNULAR VALVE

BACKGROUND OF THE INVENTION

1. Field of the Invention

The present invention relates to an automatic annular valve including a valve seat, a valve guard, and a valve element arranged in a reciprocating manner between the valve seat and the valve guard, whereby the valve element is formed of a sealing element made of concentric sealing rings sealingly cooperating with the valve seat, and including further a synchronizing plate arranged on the opposite side of the sealing rings facing the valve seat.

2. The Prior Art

In case of annular valves, especially for sealing purposes, the valve element can be designed having a valve plate provided with either a row of annular openings or a plurality of separate concentric sealing rings. A design having a valve plate can be seen in EP 300 989 A1, for example, which describes a valve element including a soft locking plate and a hard guide plate lying directly against it. Moreover, a damping plate is provided in the valve. When using concentric sealing rings, it is already known in the art to additionally use a synchronizing plate which rests against the sealing rings and is moved in conjunction with said rings to synchronize and dampen the movement of the individual sealing rings. The sealing rings and the synchronizing plate thereby form the valve element together whereby the sealing rings and the synchronizing plate are, however, only loosely placed against one another. The damping effect of the synchronizing plate is the result of the proper weight of the synchronizing plate, on the one hand, or the synchronizing plate can also be biased by a spring, on the other hand. The design including a synchronizing plate offers additionally the advantage that large and robust springs can be selected which can be affixed at the center of the synchronizing plate which is formed of radial cross pieces and openings extending in circumferential direction. For example, an annular valve of this type is disclosed in AT 391 928 B or EP 345 245 A2. An auxiliary damping plate may still be provided in the annular valve as shown in EP 345 245 A2 as well. However, such a damping plate acts independently from the sealing element and is arranged at a distance apart from the sealing element and it only serves to further dampen the movement of the ring opening essentially by its proper weight after a specific opening distance of the valve.

Due to their different employment which is intended the concentric sealing rings and the synchronizing plate place different requirements on the material to be selected. The sealing rings cooperate with the valve seat of the annular valve and achieve the function of sealing whereby the sealing rings sealingly cover the openings of the valve seat in the closed condition of the valve. The synchronizing plate is stopped by the valve guard at the end of the ring opening movement. Even though there exists a certain damping effect, the synchronizing plate impacts the valve guard at high velocity with each opening, which naturally stresses the synchronizing plate correspondingly. Besides, the synchronizing plate must be correspondingly stable against deformation to be able to synchronize the sealing rings.

However, since the sealing rings and the synchronizing plate lie directly against one another, their type of material cannot be selected solely based on the required function and their contact to one another has to be considered in view of wear upon both parts. The choice of material is therefore not optimal under certain circumstances and concessions have to be made relative to functioning since favorable materials in terms of wear could result in a very bad combination of materials.

In addition, experience shows that sealing rings can slowly cut into the synchronizing plate during operation, based on the frequent change in loads and particularly also based on the high switch-over frequency, especially if said synchronizing plate is made of synthetic material. This can be especially observed when the sealing rings as well as the synchronizing plate are made of a synthetic material, especially fiber-reinforced synthetic material. In this case, the sealing ring and the synchronizing plate even cut into each other. This leads to an increased wear of the synchronizing plate and/or the sealing rings, and to an unacceptable damage to these parts with time, impairing the sealing function so that these parts have to be often replaced.

It is therefore the object of the present invention to further develop an annular valve of the aforementioned type in such a manner that the wear of moving parts of the valve element in the annular valve is reduced.

SUMMARY OF THE INVENTION

This object is achieved according to the invention in that a metallic separation plate is arranged in the valve element between the synchronizing plate and the sealing rings and whereby the sealing rings, the separating plate and the synchronizing plate are arranged lying loosely against one another. Through the use of a metallic separation plate, which separates the sealing rings and the synchronizing rings, the material for the sealing rings can be selected mainly based on the sealing function and consistency in dimension with consideration on the material of the valve seat, whereas the material of the synchronizing plate must be chosen almost exclusively according to the required impact resistance and stability, without having to take any consideration to one another. Moreover, it is prevented thereby that the sealing rings and the synchronizing plate wear each other down. The intended function of the sealing rings and the synchronizing plate can be achieved in the best possible way through an optimal selection in material whereby the wearing of these parts is still reduced in essence. Since the separating plate does not serve any other function other than the separation of sealing rings and the synchronizing plate, said separating plate can be made very thin and thus light in weight so that the function of the annular valve is influenced thereby only insignificantly.

The synchronizing plate must not be too heavy to make a high number of switch-over functions possible and for that reason light synthetic material is preferably used as material for the synchronizing plate, particularly fiber reinforced synthetic material, which is sufficiently strong and still light enough. The sealing rings may also be made of a metallic material or preferably of a synthetic material, especially fiber reinforced synthetic material, especially if a high number of switch-over functions is desired.

The separating plate is preferably made of a flat, thin metal disk having a plurality of preferably annular flow passages separated by radial cross pieces having the function of separating said passages. Moreover, such a thin metallic disk can be simply manufactured through a simple and cost-effective punching process.

Rotating resistance of the separating plate relative to the synchronizing plate can be achieved in a very simple manner in that projections are arranged on the separating plate while being radially oriented and extending in the direction of the synchronizing plate, whereby said projections engage the opening in the synchronizing plate.

Radial guidance of the separating plate relative to the synchronizing plate can be achieved equally easily in that projections are arranged on the separating plate in circumferential direction and oriented in the direction of the synchronizing plate, whereby said projections engage the opening in the synchronizing plate. This has additionally the advantage that guidance of the metallic separating plate along metallic components of the annular valve can be avoided thereby and whereby wearing of these metallic parts can be eliminated, especially during dry-running of the annular valve.

It is advantageous to have a plurality of separate ring guide studs arranged in radial and circumferential direction on the valve seat for radial and axial guidance of the sealing rings to avoid having guiding means for the sealing rings extending from the valve guard through the synchronizing plate, which would restrict the available flow cross section. However, said ring guide studs can be eliminated if projections are arranged on the separating plate oriented in circumferential direction and extending in the direction of the sealing rings, whereby said projections encompass at least one sealing ring radially on the outside as well as radially on the inside. Thus, the sealing rings can be guided directly by means of the separating plate, which also simplifies the structural design of the annular valve.

The projections are advantageously lugs bent upwardly from the plane of the separating plate. The separating plate can be manufactured thereby together with said lugs in a very simple punching and bending process.

The present invention is described in the following with the aid of the attached schematic but non-limiting drawings.

DETAILED DESCRIPTION OF THE PREFERRED EMBODIMENTS

Figure 1:
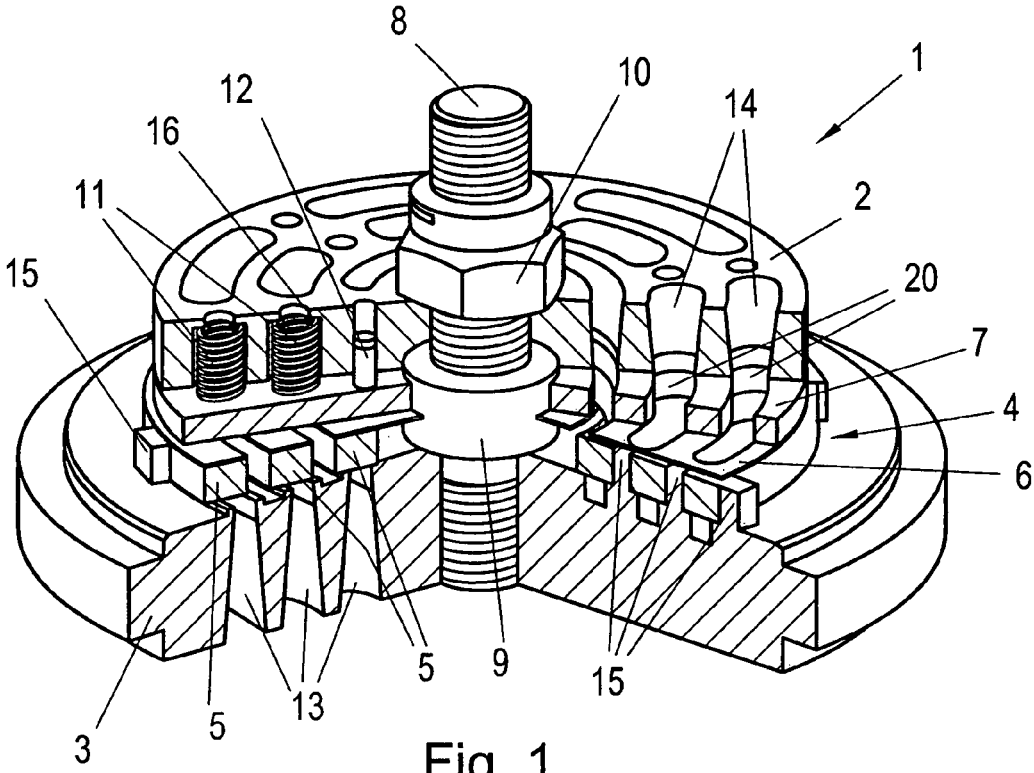
FIG. 1 shows a section through an annular valve according to the invention.

The basic design of an annular valve 1 is known in the art heretofore and for that reason it is here only briefly discussed. An annular valve 1 for employment in compressors, for example, consists of a valve seat 3 and a valve guard 2. A valve element 4 is arranged between the same, which is moved back and forth between the valve seat 3 and the valve guard 2, and which takes on the sealing function in cooperation with the valve seat 3 whereby it opens the annular flow passages 13 in the valve seat 1. The individual parts of the annular valve 1 are held together by means of a through-going bolt 8 and a nut 10. The space between the valve seat 3 and the valve guard 2, and thereby the possible valve lift, is adjusted through a spacer disk 9 that is arranged on the bolt 8. Annular outlet passages 14 are additionally arranged in the valve guard 2.

The valve element 4 comprises concentrically arranged sealing rings 5 which cooperate with the valve seat 3. Moreover, associated and cooperating sealing surfaces are respectively arranged on the sealing rings 5 and on the valve seat 3. The sealing surfaces on the sealing rings 5 can be flat, for example (which means they can lie at a normal plane to the axis of the annual valve 1); however, the sealing rings 7 could also be provided with tapered edges serving as sealing surfaces, for example—or the sealing rings 5 could also have toroidal sealing surfaces. Any sealing surfaces formed otherwise are still possible in principle. In any case, all correspondingly arranged sealing surfaces on the valve seat 3 are shaped to match each other.

A number of guide studs 15 projecting axially from the valve seat 3 in the direction of the sealing rings 5 are arranged on the valve seat 3 whereby said guide studs are distributed along the circumference of said valve seat at varying radial distances to one another, and whereby the individual sealing rings 5 are arranged between said ring guide studs in radial and in axial direction. The ring guide studs 15 project thereby from the valve seat 3 at least to such a degree that the sealing rings 5 remain in place during the entire opening movement of the ring.

Moreover, the valve element 4 may comprise a synchronizing plate 7, which is arranged on the sides of the sealing rings 5 facing away from the valve seat 3 and which covers the sealing rings 5. The synchronizing plate 7 is biased by a row of helical springs 11 arranged in spring pockets 16 in the valve guard 2. The helical springs 11 press thereby the sealing rings 5 against the valve seat 3 with the synchronizing plate 7. The sealing rings 5 are lifted away from the valve seat 3 through the existing gas pressure acting against the force of the helical springs 11 during the opening movement of the rings. Flat springs could also be provided, as known in the art, in place of the helical springs 11—or spring action could be achieved through resilient arms bent away from the synchronizing plate 7.

A metallic separating plate 6 is arranged between the synchronizing plate 7 and the sealing rings 5, which prevents that the synchronizing plate 7 and the sealing rings 5 come into direct contact and wear each other down. The separating plate 6 is a thin flat metallic disk, for example, but it could also be shaped in any other way, e.g., curved (depending on the shape of the synchronizing plate 7 and/or the sealing rings).

The synchronizing plate 7, the separating plate, and the sealing rings form the valve element 4 of the annular valve 1, they lie loosely against one another and are moved mutually during the ring opening movement. Through the separation of the synchronizing plate 7 and the sealing rings 5 by the separating plate 6, these parts can no longer wear each other down by the continuous movement of the valve element 4.

Figure 3:
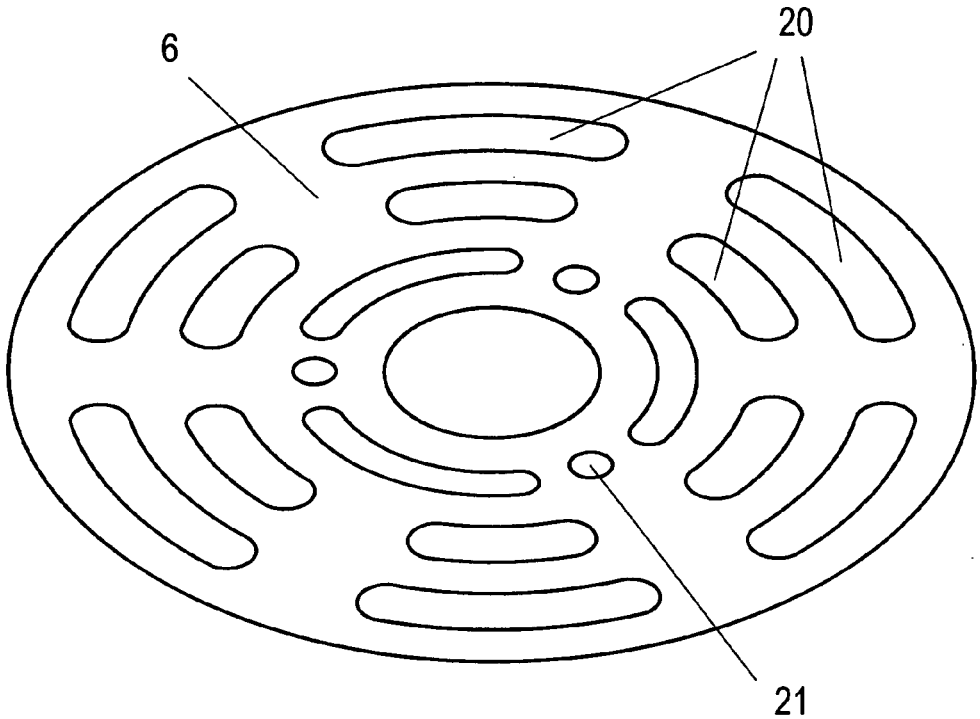
FIG. 3 shows a detailed illustration of a flat separating plate.

Of course, a number of preferably annular flow passages 20 are arranged again in the synchronizing plate 7 and the separating plate 6 (actually a number of semi-circular sections which are separated by radial cross pieces), so that the gaseous medium can pass through the annular valve 1 with the least restriction possible, as shown in FIG. 3 in the separating plate 6, for example.

Figure 2:
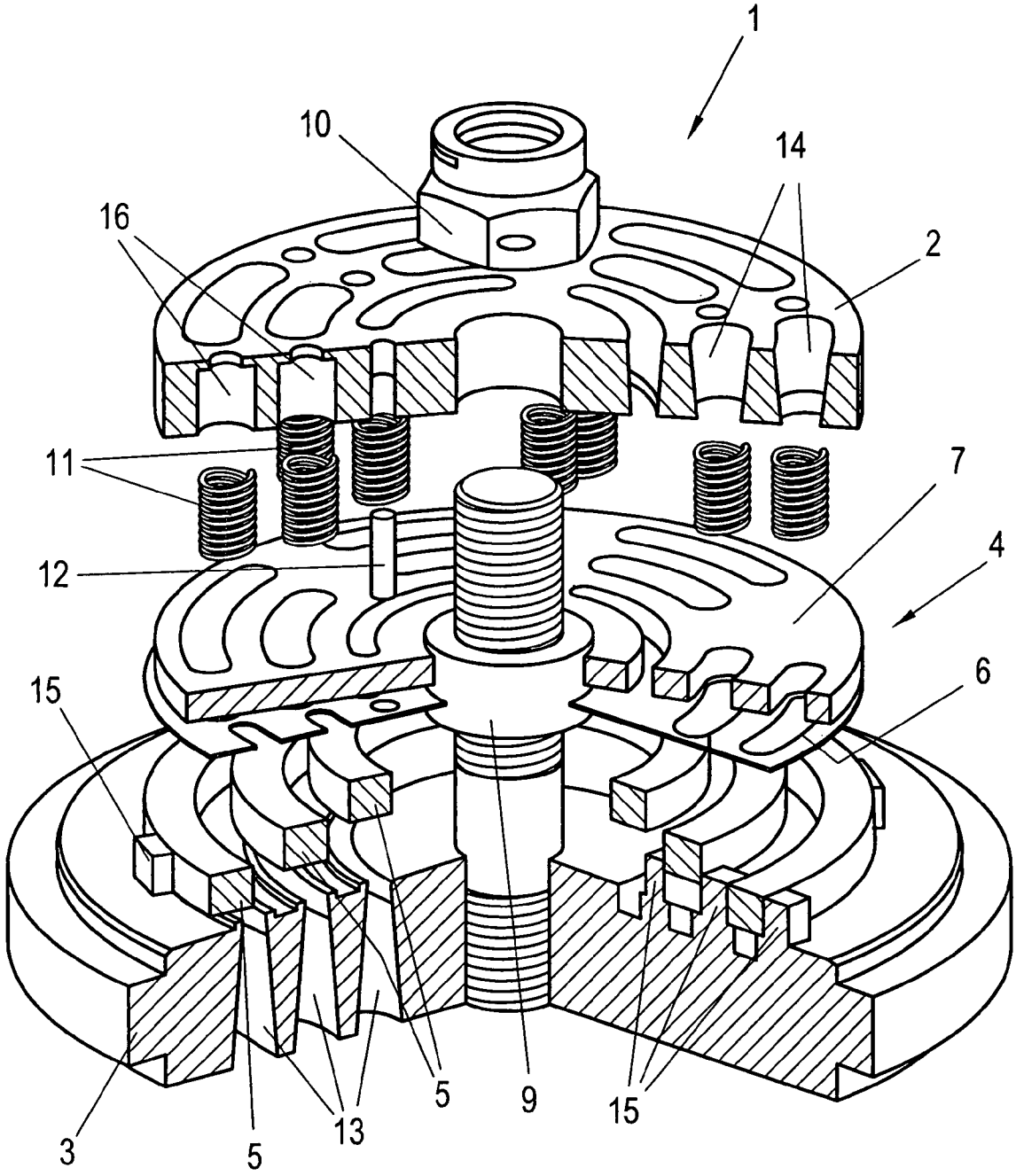
FIG. 2 shows an exploded view of said annular valve.

Since the flow openings 20 of the synchronizing plate 7 and of the separating plate 6 remain properly positioned relative to the through-passages 13 of the valve seat and the outlet passages 14 of the valve guard 2 (and the available flow diameter is not reduced), it is prevented thereby that these parts are twisted relative to one another and it is also prevented that the through-flow openings 20 and/or the passages 13, 14 are partially covered thereby. A locking pin 12 may be pushed additionally through a corresponding opening in the valve guard 2, the synchronizing plate 7, and the separating plate 6, as shown in FIG. 1 and FIG. 2. This prevention against rotation can naturally be accomplished in other ways, e.g.

through corresponding projections and stops on the individual parts. The synchronizing plate 7 and the separating plate 6 are guided in radial direction and in axial direction on the spacer disk 9.

Figure 4:
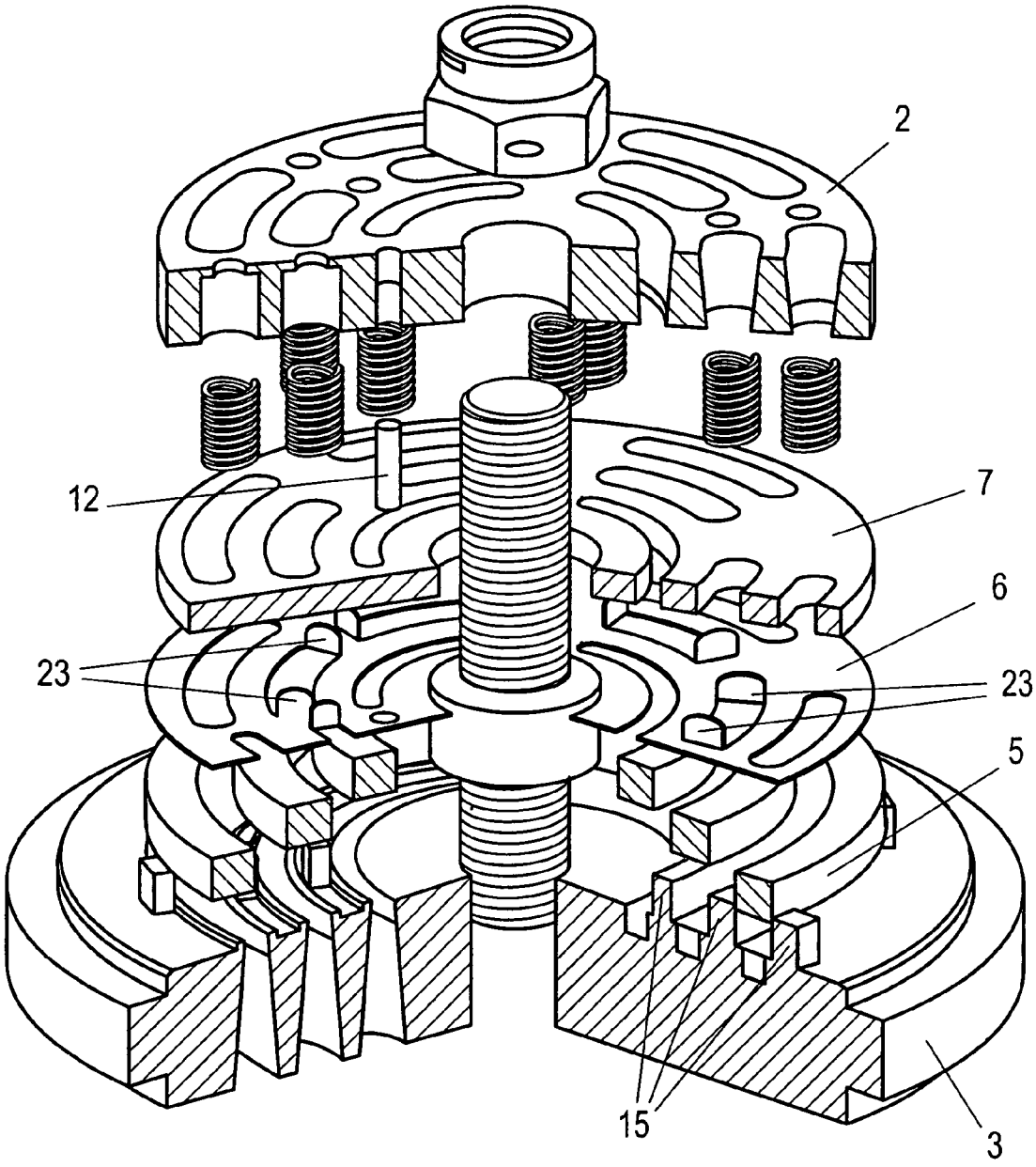
FIG. 4 shows an exploded view of an additional embodiment example of an annular valve.
Figure 5:
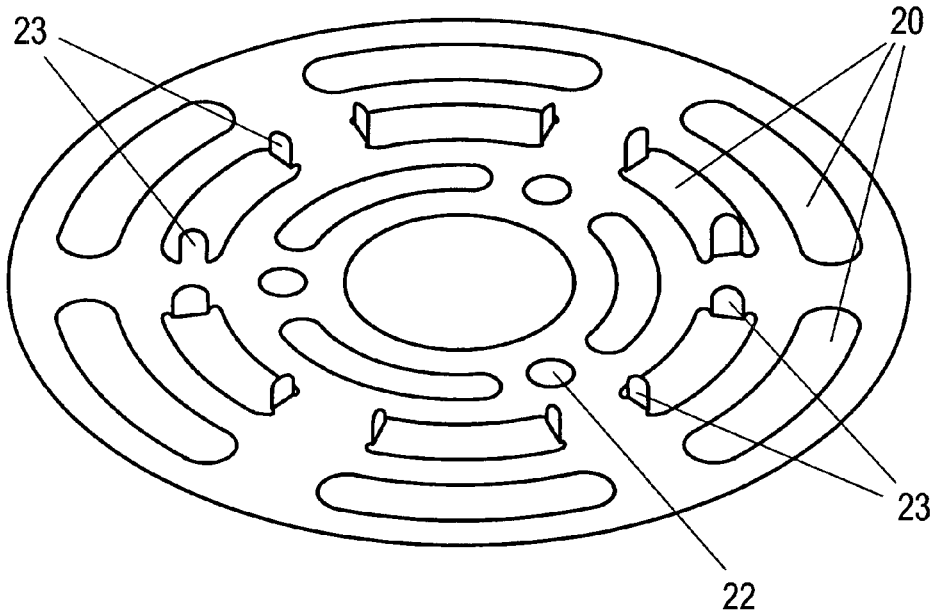
FIG. 5 shows another design of a separating plate according to the invention.

Prevention against rotation of the separating plate 6 can also be achieved by radially oriented projections extending from the plane of the separating plate 6. In the present case there are lugs which are bent upwardly from the plane of the separating plate 6 in the direction of the synchronizing plate 7, as shown in FIG. 4 and FIG. 5. Radially oriented means thereby that the projection is provided with a stopping face in radial direction and movement in circumferential direction can be prevented thereby. In addition, the ends of some annular openings 20 lying in circumferential direction are bent upward by 90°, for example. Said lugs 23 engage these openings of the synchronizing plate 7, preferably in the annular flow passages 20, and thereby the rotation of the separating plate 6 relative to the synchronizing plate 7 is prevented. Since the separating 6 plate is very thin, the available flow cross section in the synchronizing plate is reduced only insignificantly through the upward bent lugs 23. A locking pin 12 is therefore no longer necessary for the separating plate 6 and the separating plate 6 could therefore be made without an opening 21 for the locking pin 12 or it could be made with correspondingly larger openings 22 so that the locking pin 12 does no longer make contact with the separating plate 6. Of course, a correspondingly three-dimensional shape of the separating plate could have the same effect as the upward bent lugs 23, e.g. through correspondingly projecting or molded-on lips. However, the upward bent lugs 23 are an especially advantageous design in terms of manufacturing since the separating plate 6 can then be manufactured by a simple punching and bending process, for example.

Figure 7:
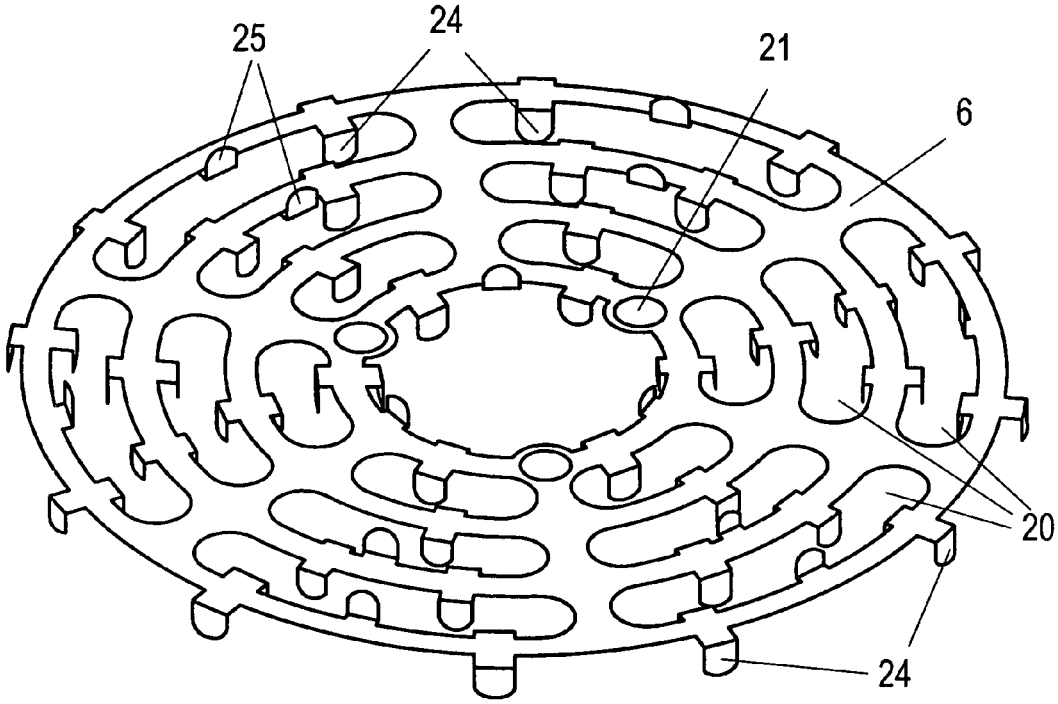
FIG. 7 shows an additional embodiment of a separating plate according to the invention.
Figure 6:
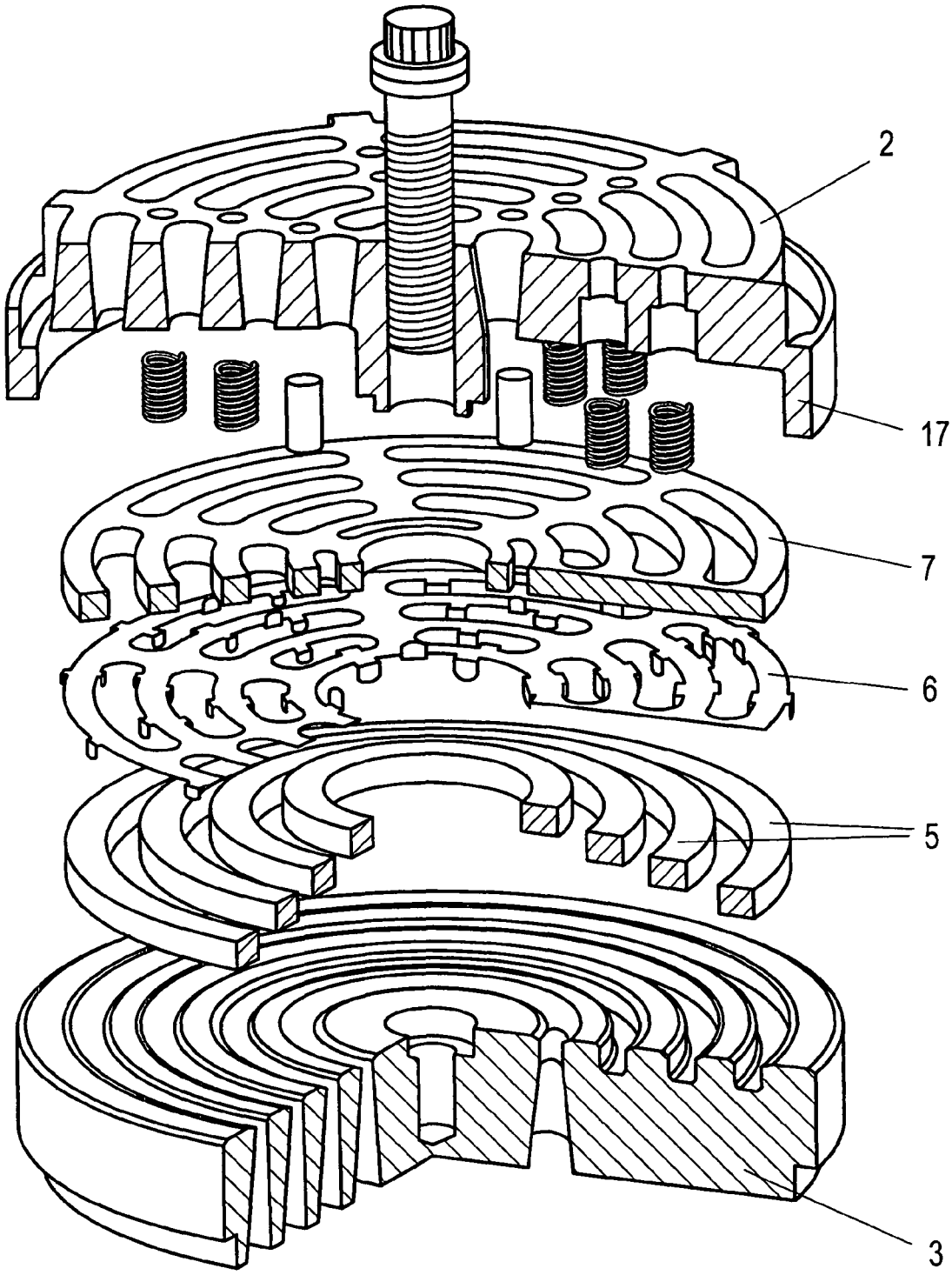
FIG. 6 shows an exploded view of yet another embodiment example of an annular valve.

In another possible embodiment of the invention, the separating plate 6 could have projections oriented in circumferential direction and extending toward the synchronizing plate 7, here in the form of upward bent lugs 25, which could take over the radial guidance of the separating plate 6, as shown exemplarily in FIG. 6 and FIG. 7. Oriented in circumferential direction means thereby that the projection has a stopping face in circumferential direction and movement in radial direction can be prevented thereby. Said lugs 25 engage thereby again the openings in the synchronizing plate 7, preferably annular flow openings 20, and thereby the radial displacement of the separating plate 6 relative to the synchronizing plate 7 is to be prevented. The lugs 25 are thereby preferably arranged symmetrically. Radial guidance of the separating plate 6 on the spacer disk 9 is therefore no longer required, which eliminates wear caused by the movement of the valve element 4 between the metallic separating plate 6 and other metal parts of the annular valve 1, e.g. the spacer disk 9. A high degree of freedom against wear can be made possible thereby especially during dry-running.

Figure 8:
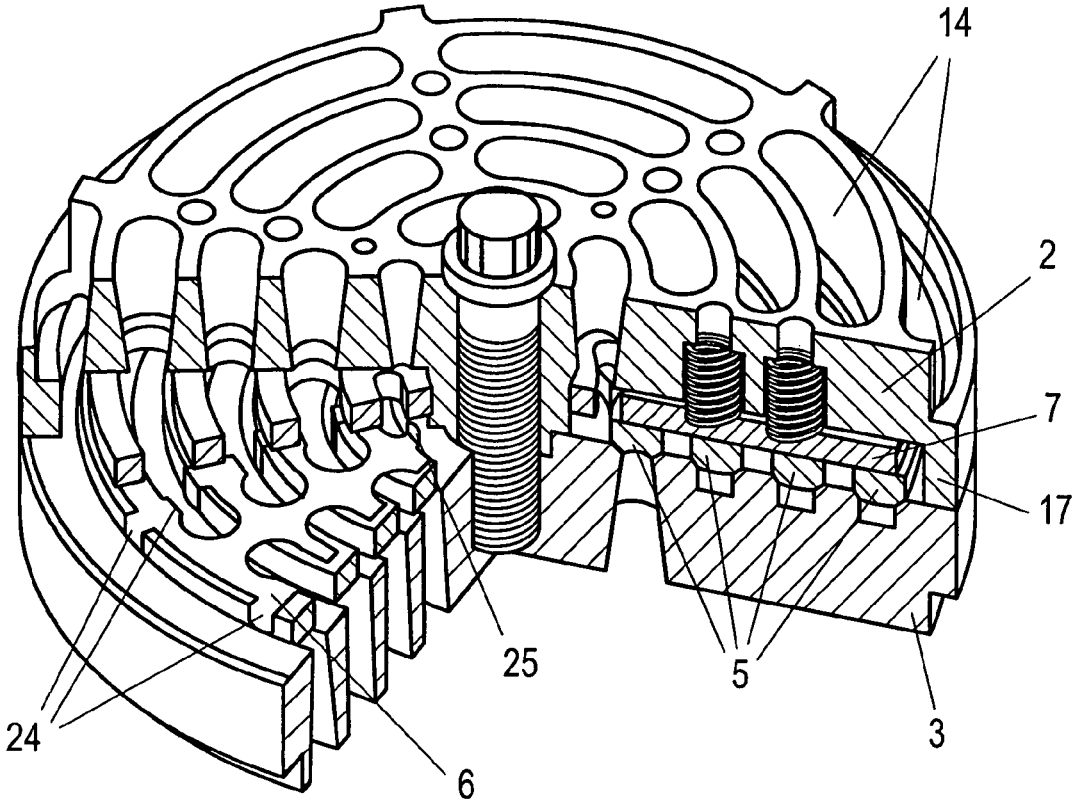
FIG. 8 shows a section through an additional annular valve according to the invention.

Just the same, ring guide studs 15 on the valve seat 3 could be eliminated if projections are provided, which are oriented in circumferential direction and are extending in the direction of the sealing rings 5 to serve as guides for the sealing rings 5, e.g. here the upward bent lugs 24, as shown in FIGS. 6, 7 and 8. Equally, there could also be provided a corresponding three-dimensional shape of the separating plate 6 (lips, projections, stopping faces etc.). To guide the sealing rings 5 securely in radial direction, the lugs 24 guiding the sealing ring 5 are divided along the circumference of the separating plate 6 and said lugs 24 are arranged in radial direction in such a manner that they encompass each sealing ring 5 inwardly and outwardly in radial direction, and radial displacement of the sealing rings 5 is thereby prevented. Two associated rows of lugs 24 affect thereby the radial guidance of one sealing ring 5.

The lugs 23, 24, 25 or a correspondingly equivalent three-dimensional shape (projections) of the separating plate 6 can be naturally combined to achieve a desired guiding function of the separating plate 6 and/or the sealing rings 5.

An axial shoulder 17 is provided radially outward on the valve guard 2 of the annular valve 1 according to the invention, whereby said shoulder 17 is sealingly attached to the valve seat 3 in the assembled condition of the annular valve 1 whereby it radially encompasses the valve element on the outside. An additional outlet passage 14 can be created radially outside on the annular valve 1, which advantageously increases the available flow cross section. Besides, the spacer disk 9 is replaced in this embodiment example by a central axial projection of the valve guard 2.

The invention claimed is:

1. An automatic annular valve comprising a valve seat, a valve guard, a valve element reciprocatingly arranged between the valve seat and the valve guard, and a spring element, the valve element comprising a sealing element made of concentric sealing rings sealingly cooperating with the valve seat, a synchronizing plate located on an opposite side of the sealing rings from the valve seat, and a generally flat metallic separation plate located between the synchronizing plate and the sealing rings, the sealing rings, the separating plate and the synchronizing plate being loosely positioned against one another, the spring element being in contact with the valve guard and the synchronizing plate and pressing the synchronizing plate, the separation plate and the sealing rings together against the valve seat.

2. The automatic annular valve according to claim 1, wherein the synchronizing plate consists of fiber reinforced synthetic material.

3. The automatic annular valve according claim 1, wherein the sealing rings consists of fiber reinforced synthetic material.

4. The automatic annular valve according to claim 1, wherein the separating plate is a metal disk having a plurality of annular flow passages divided by radial cross pieces.

5. The automatic annular valve according to claim 1, wherein the separating plate includes projections oriented in a radial direction and extending in a direction of the synchronizing plate, whereby said projections engage an opening in the synchronizing plate.

6. The automatic annular valve according to claim 1, wherein the separating plate includes projections oriented in a circumferential direction and extending in a direction of the synchronizing plate, whereby said projections engage an opening in the synchronizing plate.

7. The automatic annular valve according to claim 1, including a number of separate ring guide studs extending in radial and circumferential directions on the valve seat for radial and axial guidance of the sealing rings.

8. The automatic annular valve according to claim 1, including projections on the separating plate oriented in circumferential direction and extending in a direction of the sealing rings, whereby said projections encompass at least one sealing ring radially on the outside as well as radially on the inside.

9. The annular valve according to claim 8, wherein the projections are lugs bent upwardly from a plane of the separating plate.

10. The annular valve according to claim 1, comprising a single metallic separation plate.

* * * * *